US007815696B2

(12) United States Patent
Krull

(10) Patent No.: US 7,815,696 B2
(45) Date of Patent: Oct. 19, 2010

(54) OXIDATION-STABILIZED LUBRICANT ADDITIVES FOR HIGHLY DESULFURIZED FUEL OILS

(75) Inventor: Matthias Krull, Harxheim (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 1181 days.

(21) Appl. No.: 11/391,643

(22) Filed: Mar. 28, 2006

(65) Prior Publication Data

US 2006/0162241 A1 Jul. 27, 2006

Related U.S. Application Data

(63) Continuation of application No. 10/459,180, filed on Jun. 11, 2003, now abandoned.

(30) Foreign Application Priority Data

Jul. 9, 2002 (DE) ..... 102 30 771
Nov. 14, 2002 (DE) ..... 102 52 973

(51) Int. Cl.
*C10L 1/18* (2006.01)

(52) U.S. Cl. ..... 44/388; 44/389; 44/393; 44/450

(58) Field of Classification Search ..... 44/389, 44/450, 388, 393
See application file for complete search history.

(56) References Cited

U.S. PATENT DOCUMENTS

| | | | | |
|---|---|---|---|---|
| 2,499,365 | A | 3/1950 | DeGroote | |
| 3,245,924 | A | 4/1966 | Cox | |
| 4,211,534 | A | 7/1980 | Feldman | |
| 4,612,880 | A * | 9/1986 | Brass et al. | 123/1 A |
| 4,670,516 | A | 6/1987 | Sackmann | |
| 4,713,088 | A | 12/1987 | Tack | |
| 4,810,260 | A | 3/1989 | Tack | |
| 4,985,048 | A | 1/1991 | Wirtz | |
| 5,186,720 | A | 2/1993 | Feustel | |
| 5,200,484 | A | 4/1993 | Reimann | |
| 5,254,652 | A | 10/1993 | Reimann | |
| 5,389,113 | A | 2/1995 | Demmering | |
| 5,391,632 | A | 2/1995 | Krull | |
| 5,599,358 | A | 2/1997 | Giavazzi | |
| 5,705,603 | A | 1/1998 | Krull | |
| 5,743,923 | A | 4/1998 | Davies | |
| 5,767,190 | A | 6/1998 | Krull | |
| 5,789,510 | A | 8/1998 | Krull | |
| 5,833,722 | A | 11/1998 | Davies | |
| 5,855,628 | A | 1/1999 | Hashimoto | |
| 5,882,364 | A | 3/1999 | Dilworth | |
| 5,972,038 | A | 10/1999 | Amestica | |
| 5,998,530 | A | 12/1999 | Krull | |
| 6,010,545 | A | 1/2000 | Davies | |
| 6,010,989 | A | 1/2000 | Krull | |
| 6,232,277 | B1 | 5/2001 | Ledeore | |
| 6,248,142 | B1 | 6/2001 | Caprotti | |
| 6,475,250 | B2 | 11/2002 | Krull | |
| 2001/0013196 | A1 | 8/2001 | Krull | |

FOREIGN PATENT DOCUMENTS

| | | |
|---|---|---|
| CA | 1271895 | 7/1990 |
| CA | 2020104 | 12/1990 |
| EP | 061 894 | 10/1982 |
| EP | 629 231 | 12/1994 |
| EP | 0 680 506 | 8/1995 |
| WO | WO 01/19941 | 3/2001 |

OTHER PUBLICATIONS

English Language Abstract of DE 34 43 475, May 28, 1986.
English Language Abstract of EP 0 254 284, Jan. 27, 1988.
English Language Abstract of EP 0271 738, Jun. 22, 1988.
English Language Abstract of EP 0 543 356, May 26, 1993.
English Language Abstract of EP 0 398 101, Nov. 22, 1990.
English Language Abstract of DE 101 11 857, Sep. 12, 2002.
English Language Abstract of DE 196 14 722, Oct. 16, 1997.
Roemp Chemi Lexicon, 9th Ed, Thieme Verlag, 1988-1992, vol. 4, pp. 3351-ff.
N.A. Plate and V.P. Shibaev, "Comb-like Polymers-Structure and Properties", J. Polymer Science Macromolecular Review, 1974, vol. 8, pp. 117-ff.
D. Wei, H. Spikes, The Lubricity of Diesel Fuels, Wear, vol. 111, No. 2, pp. 217-235 (1986).

* cited by examiner

*Primary Examiner*—Cephia D Toomer
(74) *Attorney, Agent, or Firm*—Tod A. Waldrop

(57) ABSTRACT

The present invention provides an additive for improving the lubricity of fuel oils having a maximum sulfur content of 0.035% by weight. The additive comprises A) at least one partial ester composed of a di- or polyhydric alcohol and unsaturated and optionally also saturated fatty acids whose carbon chain lengths are between 8 and 30 carbon atoms, at least 60% of the fatty acid radicals containing at least one double bond, and B) at least one alkylphenol-aldehyde resin, obtainable by the condensation of
(i) at least one alkylphenol having at least one $C_6$-$C_{24}$-alkyl or $C_6$-$C_{24}$-alkenyl radical and
(ii) at least one aldehyde or ketone,
to a degree of condensation of between 2 and 50 alkylphenol units.

12 Claims, No Drawings

OXIDATION-STABILIZED LUBRICANT ADDITIVES FOR HIGHLY DESULFURIZED FUEL OILS

CROSS-REFERENCE TO RELATED APPLICATIONS

This application is a continuation application of U.S. application Ser. No. 10/459,180, filed Jun. 11, 2003 now abandoned, which is hereby incorporated by reference.

The present invention relates to additives which are composed of esters between polyols and fatty acid mixtures and alkylphenol resins having improved oxidation stability, and also to their use for improving the lubricity of highly desulfurized fuel oils.

Mineral oils and mineral oil distillates which are used as fuel oils generally contain 0.5% by weight or more of sulfur which causes the formation of sulfur dioxide on combustion. In order to reduce the resulting environmental pollution, the sulfur content of fuel oils is being ever further reduced. The standard EN 590 relating to diesel fuels has prescribed a maximum sulfur content of 350 ppm in Europe since November 1999. Further reductions of the sulfur content are in the pipeline. In Scandinavia, fuel oils having fewer than 50 ppm, and in exceptional cases having fewer than 10 ppm, of sulfur are already being used. These fuel oils are generally produced by refining, under hydrogenating conditions, the fractions obtained from crude oil by distillation. However, the desulfurization also removes other substances which confer a natural lubricity on the fuel oils. Among others, these substances include polyaromatic and polar compounds.

However, it has now been found that the wear- and attrition-reducing properties of fuel oils deteriorate with an increasing degree of desulfurization. These properties are often so inadequate that instances of corrosion are to be expected even after a short time on the materials lubricated by the fuel, for example the distributor injection pumps of diesel engines. The maximum value for the 95% distillation point of 360° C. laid down by EN 590 since the year 2000 and the further reduction of the 95% distillation point to below 350° C. and sometimes below 330° C. which has been undertaken in the meantime in Scandinavia aggravates these problems further.

The prior art therefore describes attempts which are intended to provide a solution to this problem (lubricity additives).

EP-A-0 680 506 discloses that esters of fatty acids confer improved lubricity to highly desulfurized fuel oils. Particular mention is made of glycerol monooleate and diisodecyl adipate.

EP-A-0 739 970 discloses the suitability of glycerol ester mixtures for improving the lubricity of low-sulfur fuel oils. Compositions having different degrees of esterification of the polyol and different degrees of saturation of the fatty acids are disclosed.

EP-A-0 839 174 discloses fuel oils with improved lubricity which are low in sulfur and comprise a mixture of polyolesters with unsaturated fatty acids.

DE 19614722 discloses mixtures of partial esters of highly unsaturated fatty acids with different polyols which have improved cold stability. Among other uses, these may be added to low-sulfur diesel oils as lubricant additives.

EP 0743972 discloses fuel oils having improved lubricity which comprise a lubricity improver and a nitrogen compound.

EP 0935645 discloses the use of $C_1$-$C_{30}$-alkylphenol resins as lubricity additives for low-sulfur diesel. The examples relate to $C_{18}$- and $C_{24}$-alkylphenol resins.

WO-99/61562 discloses mixtures of alkylphenol resins, nitrogen compounds and ethylene copolymers as cold and lubricity additives for low-sulfur diesel.

WO 01/19941 discloses partial esters of polyhydric alcohols with unsaturated fatty acids (pentaerythritol esterified with tall oil fatty acid) as lubricity additives having improved cold stability.

The lubricity additives based on unsaturated fatty acids and their derivatives can resinify on prolonged storage of the additive, and of the additized oils, in particular at elevated temperature, to give products which only have limited oil solubility. This can lead to the formation of separate viscous layers and deposits in the storage container of the additive, in the fuel oil and also in the engine. The combustion and condensation products of glycerol, for example, are suspected of being responsible for coke residues and deposits on the injection nozzles of highly supercharged diesel engines.

The effectiveness of the lubricity additives currently used is often unsatisfactory, so that either very high dosages or synergists have to be used.

The fatty acid esters based on commercial fatty acid mixtures of the prior art additionally show a marked tendency to emulsify in the fuel oils additized by them. This means that emulsification of the water in the fuel oil takes place on contact of such a fuel oil with water. These emulsions to be found in particular on the oil/water phase boundary can only be removed with great difficulty, if at all. Since these emulsions as such cannot be used directly as fuel oils, they reduce the value of the products. This problem occurs to a particularly high degree when esters based on natural fatty acid mixtures are used.

It is an object of the present invention to find lubricity-improving additives for desulfurized fuel oils which have an improved oxidation stability and, at the same time, an improved effectiveness as lubricity additive compared to the prior art.

It has been found that, surprisingly, combinations of partial esters of unsaturated fatty acids and polyols with alkylphenol-aldehyde resins have a distinctly improved oxidation stability and, in the case of selected combinations of hydroxyl number and iodine number, have a particularly low emulsifiability. In addition, they display a lubricity superior to the individual constituents in low-sulfur fuel oils.

The invention therefore provides an additive for improving the lubricity of fuel oils having a maximum sulfur content of 0.035% by weight, comprising A) at least one partial ester composed of a di- or polyhydric alcohol and unsaturated and optionally also saturated fatty acids whose carbon chain lengths are between 8 and 30 carbon atoms, at least 60% of the fatty acid radicals containing at least one double bond, and B) at least one alkylphenol-aldehyde resin, obtainable by the condensation of (i) at least one alkylphenol having at least one $C_6$-$C_{24}$-alkyl or $C_6$-$C_{24}$-alkenyl radical and (ii) at least one aldehyde or ketone, to a degree of condensation of between 2 and 50 alkylphenol units.

The invention further provides fuel oils having a maximum sulfur content of 0.035% by weight which comprise the additives according to the invention.

The invention further provides the use of the additives according to the invention for improving the lubricity of fuel oils having a maximum sulfur content of 0.035% by weight.

The invention further provides a process for improving the lubricity of fuel oils having a maximum sulfur content of 0.035% by weight by adding the additive according to the invention to the fuel oils.

Preferred fatty acids which are a constituent of the esters A) are those having from 10 to 26 carbon atoms, in particular from 12 to 22 carbon atoms. The alkyl radicals or alkenyl radicals of the fatty acids consist substantially of carbon and hydrogen. However, they can also bear further substituents, for example hydroxyl, halogen, amino or nitro groups, as long as these do not impair the predominant hydrocarbon character. The fatty acids preferably contain at least one double bond. They can contain a plurality of double bonds, for example 2 or 3 double bonds, and be of natural or synthetic origin. In the case of polyunsaturated carboxylic acids, their double bonds can be isolated or else conjugated. Preference is given to mixtures of two or more unsaturated fatty acids having from 10 to 26 carbon atoms. In particularly preferred fatty acid mixtures, at least 50% by weight, in particular at least 75% by weight, especially at least 90% by weight, of the fatty acids contain one or more double bonds. The iodine numbers of the parent fatty acids or fatty acid mixtures of the esters according to the invention are preferably above 100 g of l/100 g, more preferably between 105 and 190 g of l/100 g, in particular between 110 and 180 g of l/100 g and especially between 120 and 180 g of l/100 g, of fatty acid or fatty acid mixture.

Examples of suitable unsaturated fatty acids include oleic acid, erucic acid, palmitoleic acid, myristoleic acid, linoleic acid, linolenic acid, elaeosteric acid, arachidonic acid and/or ricinoleic acid. According to the invention, preference is given to using fatty acid mixtures and fractions obtained from natural fats and oils, for example peanut oil fatty acid, fish oil fatty acid, linseed oil fatty acid, palm oil fatty acid, rapeseed oil fatty acid, ricinoleic oil fatty acid, castor oil fatty acid, colza oil fatty acid, soya oil fatty acid, sunflower oil fatty acid, safflower oil fatty acid and tall oil fatty acid, which have appropriate iodine numbers.

Likewise suitable as fatty acids are dicarboxylic acids such as dimerized fatty acids and alkyl- and also alkenylsuccinic acids having $C_8$-$C_{50}$-alk(en)yl radicals, preferably having $C_8$-$C_{40}$-, in particular having $C_{12}$-$C_{22}$-alkyl radicals. The alkyl radicals can be linear or branched (oligomerized alkenes, polyisobutylene) and saturated or unsaturated. The dicarboxylic acids can be used as such or in mixtures with monocarboxylic acids, and preference is given to proportions of the dicarboxylic acids in mixtures of up to 10% by weight, in particular less than 5% by weight.

In addition, the fatty acid mixtures can contain minor amounts, i.e. up to 20% by weight, preferably less than 10% by weight, in particular less than 5% by weight and especially less than 2% by weight, of saturated fatty acids, for example lauric acid, tridecanoic acid, myristic acid, pentadecanoic acid, palmitic acid, margaric acid, stearic acid, isostearic acid, arachidic acid and behenic acid.

The fatty acids can also contain 1-40% by weight, especially 1-25% by weight, in particular 1-5% by weight, of resin acids.

Suitable alcohols contain preferably from 2 to 6, in particular from 3 to 4, carbon atoms, and from 2 to 5, in particular from 3 to 4, hydroxyl groups, but a maximum of one hydroxyl group per carbon atom. Particularly suitable alcohols are ethylene glycol, diethylene glycol, propylene glycol, glycerol, trimethylolpropane, neopentyl glycol and pentaerythritol, and also the oligomers obtainable therefrom by condensation and having from 2 to 10 monomer units, for example polyglycerol.

The partial esters can be prepared from alcohols and fatty acids by esterification in a known manner. As an alternative, it is also possible to partially hydrolyze naturally occurring fats and oils. Esters according to the invention are those which can be prepared from a di- or polyhydric alcohol and a fatty acid or a mixture of fatty acids. These include mixtures, for example, of mono-, di- and/or triesters, or optionally higher esters, of an alcohol with different fatty acids, of mono-, di- and/or triesters, or optionally higher esters, different alcohols with different fatty acids, or else mixtures of mono-, di- and/or triesters, or optionally higher esters, of one or more alcohols with different fatty acids. Preference is given to those esters which can be prepared from a fatty acid mixture.

The esters according to the invention preferably have iodine numbers of more than 50 g of l/100 g of ester, more preferably between 90 and 200 g of l/100 g of ester, in particular between 100 and 180 g of l/100 g of ester and especially between 110 and 150 g of l/100 g of ester. The iodine numbers correspond to the iodine number of the parent fatty acid mixture and the alcohol used for esterification in a stoichiometric manner.

Preference is likewise given to partial esters whose OH numbers are between 10 and 200 mg of KOH/g of ester, more preferably between 100 and 200 mg of KOH/g of ester, in particular between 110 and 195 mg of KOH/g of ester, especially between 130 and 190 mg of KOH/g of ester. In general, these are mixtures of different esters, for example mixtures of mono-, di- and triglycerides, and mixtures as result from the esterification of polyols.

The partial esters having OH numbers of between 110 and 200 mg of KOH/g of ester are notable for a very low tendency to emulsify, in particular in combination with the alkylphenol resins B). The HLB range of the additives which is limited by the OH number presumably effects a reduced affinity of the amphiphilic active ingredients for water; at the same time, the formation of surface-active and micellar structures is disrupted by the number of double bonds in the alkyl radicals characterized by means of the iodine number.

The alkylphenol-aldehyde resins (B) present in the additive according to the invention are known in principle and described, for example, in Römpp Chemie Lexikon, 9th edition, Thieme Verlag 1988-92, Volume 4, p. 3351ff. The alkyl or alkenyl radicals of the alkylphenol have 6-24, preferably 8-22, in particular 9-18, carbon atoms. They may be linear or branched, and the branch may contain secondary and also tertiary structures. They are preferably n- and isohexyl, n- and isooctyl, n- and isononyl, n- and isodecyl, n- and isododecyl, tetradecyl, hexadecyl, octadecyl, eicosyl and also tripropenyl, tetrapropenyl, pentapropenyl and polyisobutenyl up to $C_{24}$. In this context, the prefix iso means that the alkyl chain has one or more secondary branches. The alkylphenol-aldehyde resin may also contain up to 20 mol % of phenol units and/or alkylphenols having short alkyl chains, for example butylphenol. For the alkylphenol-aldehyde resin, the same or different alkylphenols may be used.

The aldehyde in the alkylphenol-aldehyde resin has from 1 to 10, preferably from 1 to 4, carbon atoms, and may bear further functional groups. It is preferably an aliphatic aldehyde, more preferably formaldehyde.

The molecular weight of the alkylphenol-aldehyde resins is preferably 350-10,000, in particular 400-5000 g/mol. This preferably corresponds to a degree of condensation n of from 3 to 40, in particular from 4 to 20. A prerequisite is that the resins are oil-soluble.

In a preferred embodiment of the invention, these alkylphenol-formaldehyde resins are those which are oligomers or polymers having a repeating structural unit of the formula

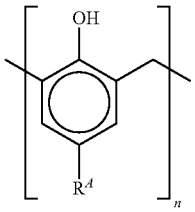

where $R^A$ is $C_6$-$C_{24}$-alkyl or -alkenyl and n is a number from 2 to 50.

The alkylphenol-aldehyde resins are prepared in a known manner by basic catalysis to give condensation products of the resol type, or by acidic catalysis to give condensation products of the novolak type.

The condensates obtained in both ways are suitable for the compositions according to the invention. Preference is given to the condensation in the presence of acidic catalysts.

To prepare the alkylphenol-aldehyde resins, an alkylphenol having 6-24, preferably 8-22, in particular 9-18, carbon atoms per alkyl group, or mixtures thereof, are reacted with at least one aldehyde, using about 0.5-2 mol, preferably 0.7-1.3 mol and in particular equimolar amounts of aldehyde, per mole of alkylphenol compound.

Suitable alkylphenols are in particular n- and isohexylphenol, n- and isooctylphenol, n- and isononylphenol, n- and isodecylphenol, n- and isododecylphenol, tetradecylphenol, hexadecylphenol, octadecylphenol, eicosylphenol, tripropenylphenol, tetrapropenylphenol and poly(isobutenyl)phenol up to $C_{24}$.

The alkylphenols are preferably para-substituted. The alkylphenols may bear one or more alkyl radicals. The proportion substituted by more than one alkyl group is preferably at most 5 mol %, in particular at most 20 mol % and especially at most 40 mol %. At most 40 mol %, in particular at most 20 mol %, of the alkylphenols used preferably bear an alkyl radical in the ortho-position. Especially, the alkylphenols are unsubstituted by tertiary alkyl groups in the ortho-position to the hydroxyl group.

The aldehyde may be a mono- or dialdehyde and bear further functional groups such as —COOH. Particularly suitable aldehydes are formaldehyde, acetaldehyde, butyraldehyde, glutardialdehyde and glyoxalic acid, preferably formaldehyde. The formaldehyde may be used in the form of paraformaldehyde or in the form of a preferably 20-40% by weight aqueous formalin solution. It is also possible to use corresponding amounts of trioxane.

Alkylphenol is customarily reacted with aldehyde in the presence of alkaline catalysts, for example alkali metal hydroxides or alkylamines, or of acidic catalysts, for example inorganic or organic acids, such as hydrochloric acid, sulfuric acid, phosphoric acid, sulfonic acid, sulfamido acids or haloacetic acids. The condensation is preferably carried out without solvent at from 90 to 200° C., preferably at from 100 to 160° C. In a further preferred embodiment, the reaction is effected in the presence of an organic solvent which forms an azeotrope with water, for example toluene, xylene, higher aromatics or mixtures thereof. The reaction mixture is heated to a temperature of from 90 to 200° C., preferably 100-160° C., and the water of reaction formed is removed during the reaction by azeotropic distillation. Solvents which release no protons under the conditions of the condensation can remain in the products after the condensation reaction. The resins may be used directly or after neutralization of the catalyst, optionally after further dilution of the solution with aliphatic and/or aromatic hydrocarbons or hydrocarbon mixtures, for example petroleum fractions, kerosene, decane, pentadecane, toluene, xylene, ethylbenzene or solvents such as ®Solvent Naphtha, ®Shellsol AB, ®Solvesso 150, ®Solvesso 200, ®Exxsol, ®ISOPAR and ®Shellsol D types.

The proportions by weight of the constituents A) and B) in the additives according to the invention may vary within wide limits depending on the application. They are preferably between 10 and 99.999% by weight of A) to from 90 to 0.001% by weight of B), in particular between 20 and 99.995% by weight of A) to from 80 to 0.005% by weight of B). To stabilize the fatty acids, preference is given to using smaller proportions of component B of from 0.001 to 10% by weight, preferably from 0.005 to 5% by weight, of B), but in contrast, to optimize the lubricity, larger proportions of B of, for example, from 5 to 90% by weight, preferably from 10 to 80% by weight and in particular from 25 to 75% by weight, are used.

It has likewise been found that, surprisingly, a further increase in effectiveness as a lubricity additive is achieved when the mixtures according to the invention are used together with nitrogen-containing paraffin dispersants. Paraffin dispersants are additives which reduce the size of the precipitating paraffin crystals on cooling of the oil and in addition prevent the paraffin particles from depositing, but instead keep them dispersed colloidally with distinctly reduced tendency to sediment.

The nitrogen-containing paraffin dispersants are preferably low molecular weight or polymeric, oil-soluble nitrogen compounds, for example amine salts, imides and/or amides which are obtained by reacting aliphatic or aromatic amines, preferably long-chain aliphatic amines, with aliphatic or aromatic mono-, di-, tri-, tetra- and/or polycarboxylic acids or their anhydrides. Particularly preferred paraffin dispersants contain reaction products of secondary fatty amines having from 8 to 36 carbon atoms, in particular dicoconut fatty amine, ditallow fatty amine and distearylamine. Other paraffin dispersants are copolymers of maleic anhydride and α,β-unsaturated compounds which can optionally be reacted with primary monoalkylamines and/or aliphatic alcohols, the reaction products of alkenyl-spiro-bislactones with amines and the reaction products of terpolymers based on α,β-unsaturated dicarboxylic anhydrides, α,β-unsaturated compounds and polyoxyalkyl ethers of lower unsaturated alcohols with amines and/or alcohols. Some suitable paraffin dispersants are listed hereinbelow.

Some of the paraffin dispersants mentioned below are prepared by reaction of compounds containing an acyl group with an amine. This amine is a compound of the formula $NR^6R^7R^8$, in which $R^6$, $R^7$ and $R^8$ may be identical or different, and at least one of these groups is $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl, and the other groups are either hydrogen, $C_1$-$C_{36}$-alkyl, $C_2$-$C_{36}$-alkenyl, cyclohexyl, or a group of the formulae $-(A\text{-}O)_x\text{-}E$ or $—(CH_2)_n—NYZ$, in which A is an ethylene or propylene group, x is a number from 1 to 50, E=H, $C_1$-$C_{30}$-alkyl, $C_5$-$C_{12}$-cycloalkyl or $C_6$-$C_{30}$-aryl, and n is 2, 3 or 4, and Y and Z are each; independently H, $C_1$-$C_{30}$-alkyl or $-(A\text{-}O)_x$. The term acyl group here is taken to mean a functional group of the following formula:

>C=O

1. Products of the reaction of alkenyl-spiro-bislactones of the formula

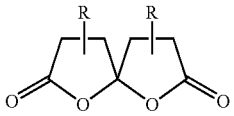

in which each R is $C_8$-$C_{200}$-alkenyl, with amines of the formula $NR^6R^7R^8$. Suitable reaction products are mentioned in EP-A-0 413 279. Depending on the reaction conditions, the reaction of compounds of the formula with the amines gives amides or amide ammonium salts.

2. Amides or ammonium salts of aminoalkylenepolycarboxylic acids with secondary amines of the formulae

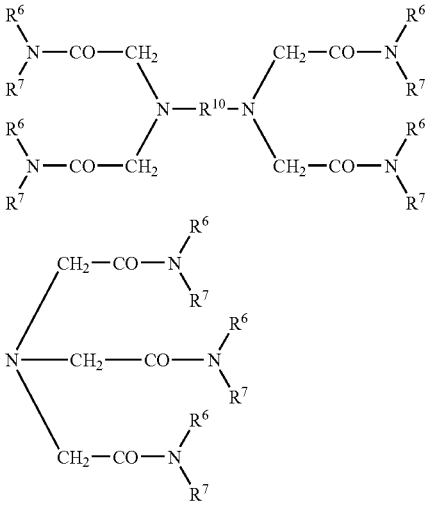

in which $R^{10}$ is a straight-chain or branched alkylene radical having from 2 to 6 carbon atoms or the radical of the formula

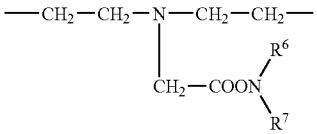

in which $R^6$ and $R^7$ are, in particular, alkyl radicals having from 10 to 30, preferably from 14 to 24, carbon atoms, and all or some of the amide structures may also be in the form of the ammonium salt structure of the formula

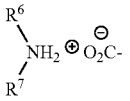

The amides or amide ammonium salts or ammonium salts, for example of nitrilotriacetic acid, of ethylenediaminetetraacetic acid or of propylene-1,2-diaminetetraacetic acid, are obtained by reaction of the acids with from 0.5 to 1.5 mol of amine, preferably from 0.8 to 1.2 mol of amine, per carboxyl group. The reaction temperatures are from about 80 to 200° C., and continuous removal of the water of reaction formed is required to prepare the amides. However, the conversion to the amide does not have to be completed, but instead from 0 to 100 mol % of the amine used may be in the form of the ammonium salt. Under analogous conditions, the compounds mentioned under B1) can also be prepared.

Suitable amines of the formula

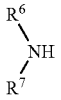

are, in particular, dialkylamines in which $R^6$ and $R^7$ are a straight-chain alkyl radical having from 10 to 30 carbon atoms, preferably from 14 to 24 carbon atoms. Specific mention may be made of dioleylamine, dipalmitylamine, dicoconut fatty amine and dibehenylamine and preferably ditallow fatty amine.

3. Quaternary ammonium salts of the formula $^+NR^6R^7R^8R^{11}X^-$ in which $R^6$, $R^7$ and $R^8$ are as defined above, and $R^{11}$ is $C_1$-$C_{30}$-alkyl, preferably $C_1$-$C_{22}$-alkyl, $C_1$-$C_{30}$-alkenyl, preferably $C_1$-$C_{22}$-alkenyl, benzyl or a radical of the formula $—(CH_2—CH_2—O)_n—R^{12}$ where $R^{12}$ is hydrogen or a fatty acid radical of the formula $C(O)—R^{13}$ where $R^{13}$=$C_6$-$C_{40}$-alkenyl, n is a number from 1 to 30, and X is halogen, preferably chlorine, or a methosulfate.

Examples of quaternary ammonium salts of this type include the following: dihexadecyldimethylammonium chloride, distearyidimethylammonium chloride, products of the quaternization of esters of di- and triethanolamine with long-chain fatty acids (lauric acid, myristic acid, palmitic acid, stearic acid, behenic acid, oleic acid and fatty acid mixtures, such as coconut fatty acid, tallow fatty acid, hydrogenated tallow fatty acid and tall oil fatty acid), such as N-methyltriethanolammonium distearyl ester chloride, N-methyltriethanolammonium distearyl ester methosulfate, N,N-dimethyldiethanolammonium distearyl ester chloride, N-methyltriethanolammonium dioleyl ester chloride, N-methyltriethanol-ammonium trilauryl ester methosulfate, N-methyltriethanolammonium tristearyl ester methosulfate and mixtures thereof.

4. Compounds of the formula

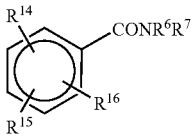

in which $R^{14}$ is $CONR^6R^7$ or $CO_2^- {}^+H_2NR^6R^7$, $R^{15}$ and $R^{16}$ are each H, $CONR^{17}{}_2$, $CO_2R^{17}$ or $OCOR^7$, $—OR^7$, $—R^{17}$ or $—NCOR^7$, and $R^{17}$ is alkyl, alkoxyalkyl or polyalkoxyalkyl and has at least 10 carbon atoms.

Preferred carboxylic acids or acid derivatives are phthalic acid (anhydride), trimellitic and pyromellitic acid (dianhydride), isophthalic acid, terephthalic acid, cyclohexanedicarboxylic acid (anhydride), maleic acid (anhydride) and alkenylsuccinic acid (anhydride). The formulation (anhydride) means that the anhydrides of said acids are also preferred acid derivatives. If the compounds of the above formula are amides or amine salts, they are preferably obtained from a secondary amine which contains a hydrogen- and carbon-containing group having at least 10 carbon atoms.

$R^{17}$ preferably contains from 10 to 30, in particular from 10 to 22, for example from 14 to 20, carbon atoms, and is preferably straight-chain or branched in the 1- or 2-position. The other hydrogen- and carbon-containing groups may be shorter, for example contain fewer than 6 carbon atoms, or may, if desired, have at least 10 carbon atoms. Suitable alkyl groups include methyl, ethyl, propyl, hexyl, decyl, dodecyl, tetradecyl, eicosyl and docosyl (behenyl).

Also suitable are polymers containing at least one amide or ammonium group bonded directly to the polymer skeleton, the amide or ammonium group bearing at least one alkyl group having at least 8 carbon atoms on the nitrogen atom. Polymers of this type can be prepared in various ways. One method is to use a polymer which contains a plurality of carboxyl or carboxylic anhydride groups and to react this polymer with an amine of the formula $NHR^6R^7$ in order to obtain the desired polymer.

Suitable polymers for this purpose are generally copolymers of unsaturated esters, such as $C_1$-$C_{40}$-alkyl (meth)acrylates, di($C_1$-$C_{40}$-alkyl) fumarates, $C_1$-$C_{40}$-alkyl vinyl ethers, $C_1$-$C_{40}$-alkyl vinyl esters or $C_2$-$C_{40}$-olefins (linear, branched or aromatic) with unsaturated carboxylic acids or reactive derivatives thereof, such as, for example, carboxylic anhydrides (acrylic acid, methacrylic acid, maleic acid, fumaric acid, tetrahydrophthalic acid, citraconic acid, preferably maleic anhydride).

Carboxylic acids are preferably reacted with from 0.1 to 1.5 mol, in particular from 0.5 to 1.2 mol, of amine per acid group, while carboxylic anhydrides are preferably reacted with from 0.1 to 2.5 mol, in particular from 0.5 to 2.2 mol, of amine per acid anhydride group, with amides, ammonium salts, amide ammonium salts or imides being formed, depending on the reaction conditions. Thus, when copolymers containing unsaturated carboxylic anhydrides are reacted with a secondary amine, half of them give amide and half of them give amine salts owing to the reaction with the anhydride group. Water can be eliminated by heating to form the diamide.

Particularly suitable examples of amide group-containing polymers for use in accordance with the invention are the following:

5. Copolymers (a) of a dialkyl fumarate, maleate, citraconate or itaconate with maleic anhydride, or (b) of vinyl esters, for example vinyl acetate, vinyl propionate, vinyl 2-ethylhexanoate or vinyl stearate, with maleic anhydride, or (c) of a dialkyl fumarate, maleate, citraconate or itaconate with maleic anhydride and vinyl acetate.

Particularly suitable examples of these polymers are copolymers of didodecyl fumarate, vinyl acetate and maleic anhydride; ditetradecyl fumarate, vinyl acetate and maleic anhydride; dihexadecyl fumarate, vinyl acetate and maleic anhydride; or the corresponding copolymers in which the itaconate is used instead of the fumarate.

In the abovementioned examples of suitable polymers, the desired amide is obtained by reaction of the polymer containing anhydride groups with a secondary amine of the formula $HNR^6R^7$ (optionally also with an alcohol if an ester amide is formed). If polymers containing an anhydride group are reacted, the resultant amino groups will be ammonium salts and amides. Polymers of this type can be used with the proviso that they contain at least two amide groups.

It is essential that the polymer containing at least two amide groups contains at least one alkyl group having at least 10 carbon atoms. This long-chain group, which may be a straight-chain or branched alkyl group, may be bonded via the nitrogen atom of the amide group.

The amines which are suitable for this purpose may be represented by the formula $R^6R^7NH$ and the polyamines by $R^6NH[R^{19}NH]_xR^7$ where $R^{19}$ is a divalent hydrocarbon group, preferably an alkylene- or hydrocarbon-substituted alkylene group, and x is an integer, preferably between 1 and 30. One or both radicals $R^6$ and $R^7$ preferably contain at least 10 carbon atoms, for example from 10 to 20 carbon atoms, for example dodecyl, tetradecyl, hexadecyl or octadecyl.

Examples of suitable secondary amines are dioctylamine and those which contain alkyl groups having at least 10 carbon atoms, for example didecylamine, didodecylamine, dicoconut amine (i.e. mixed $C_{12}$-$C_{14}$-amines), dioctadecylamine, hexadecyloctadecylamine, di(hydrogenated tallow) amine (approximately 4% by weight of n-$C_{14}$-alkyl, 30% by weight of n-$C_{10}$-alkyl, 60% by weight of n-$C_{18}$-alkyl, the remainder is unsaturated).

Examples of suitable polyamines are N-octadecylpropanediamine, N,N'-dioctadecylpropanediamine, N-tetradecylbutanediamine and N,N'-dihexadecylhexanediamine, N-(coconut)propylenediamine ($C_{12}$/$C_{14}$-alkylpropylenediamine), N-(tallow)propylenediamine ($C_{16}$/$C_{18}$-alkylpropylenediamine).

The amide-containing polymers typically have a number average molecular weight of from 1000 to 500,000, for example from 10,000 to 100,000.

6. Copolymers of styrene, derivatives thereof or aliphatic olefins having from 2 to 40 carbon atoms, preferably having from 6 to 20 carbon atoms, and olefinically unsaturated carboxylic acids or carboxylic anhydrides which have been reacted with amines of the formula $HNR^6R^7$. The reaction can be carried out before or after the polymerization.

In detail, the structural units of the copolymers are derived from, for example, maleic acid, fumaric acid, tetrahydrophthalic acid, citraconic acid, preferably maleic anhydride. They can be employed either in the form of their homopolymers or in the form of the copolymers. Suitable comonomers are the following: styrene and alkylstyrenes, straight-chain and branched olefins having from 2 to 40 carbon atoms, and mixtures thereof. Examples include the following: styrene, α-methylstyrene, dimethylstyrene, α-ethylstyrene, diethylstyrene, isopropylstyrene, tert-butylstyrene, ethylene, propylene, n-butylene, diisobutylene, decene, dodecene, tetradecene, hexadecene and octadecene. Preference is given to styrene and isobutene, particular preference is given to styrene.

Examples of specific polymers include the following: polymaleic acid, an equimolar styrene-maleic acid copolymer with an alternating structure, styrene-maleic acid copolymers with a random structure in the ratio 10:90 and an alternating copolymer of maleic acid and isobutene. The molecular weights of the polymers are generally from 500 g/mol to 20,000 g/mol, preferably from 700 to 2000 g/mol.

The polymers or copolymers are reacted with the amines at temperatures of from 50 to 200° C. over the course of from 0.3 to 30 hours. The amine here is used in amounts of approximately one mole per mole of copolymerized dicarboxylic anhydride, i.e. from about 0.9 to 1.1 mol/mol. The use of larger or smaller amounts is possible, but does not bring any advantage. If larger amounts than one mole are used, ammonium salts are partly obtained, since the formation of a second amide group requires higher temperatures, longer residence times and separation of water. If smaller amounts than one mole are used, complete conversion to the monoamide does not take place, and a correspondingly reduced action is obtained.

Instead of the subsequent reaction of the carboxyl groups in the form of the dicarboxylic anhydride with amines to give the corresponding amides, it is sometimes advantageous to prepare the monoamides of the monomers and then to copolymerize them directly in the polymerization. Usually, however, this is much more technically complex, since the amines are able to add onto the double bond of the monomeric mono- and dicarboxylic acid, and copolymerization is then no longer possible.

7. Copolymers consisting of from 10 to 95 mol % of one or more alkyl acrylates or alkyl methacrylates having $C_1$-$C_{26}$-alkyl chains and from 5 to 90 mol % of one or more ethylenically unsaturated dicarboxylic acids or anhydrides thereof, the copolymers having been substantially reacted with one or more primary or secondary amines to give the monoamide or amide/ammonium salt of the dicarboxylic acid.

The copolymers consist of from 10 to 95 mol %, preferably from 40 to 95 mol % and particularly preferably from 60 to 90 mol %, of alkyl (meth)acrylates and from 5 to 90 mol %, preferably from 5 to 60 mol % and particularly preferably from 10 to 40 mol %, of the olefinically unsaturated dicarboxylic acid derivatives. The alkyl groups of the alkyl (meth) acrylates contain from 1 to 26, preferably from 4 to 22 and particularly preferably from 8 to 18, carbon atoms. They are preferably straight-chain and unbranched. However, it is also possible for up to 20% by weight of cyclic and/or branched components to be present.

Examples of particularly preferred alkyl (meth)acrylates are n-octyl (meth)acrylate, n-decyl (meth)acrylate, n-dodecyl (meth)acrylate, n-tetradecyl (meth)acrylate, n-hexadecyl (meth)acrylate and n-octadecyl (meth)acrylate, and mixtures thereof.

Examples of ethylenically unsaturated dicarboxylic acids are maleic acid, tetrahydrophthalic acid, citraconic acid and itaconic acid, and anhydrides thereof, and fumaric acid. Preference is given to maleic anhydride.

Suitable amines are compounds of the formula $HNR^6R^7$.

In general, it is advantageous to employ the dicarboxylic acids in the form of the anhydrides, if available, in the copolymerization, for example maleic anhydride, itaconic anhydride, citraconic anhydride and tetrahydrophthalic anhydride, since the anhydrides generally copolymerize better with the (meth)acrylates. The anhydride groups of the copolymers can then be reacted directly with the amines.

The polymers are reacted with the amines at temperatures of from 50 to 200° C. over the course of from 0.3 to 30 hours. The amine here is used in amounts of from approximately one to two moles per mole of copolymerized dicarboxylic anhydride, i.e. from about 0.9 to 2.1 mol/mol. The use of larger or smaller amounts is possible, but does not bring any advantage. If larger amounts than 2 mol are used, free amine is present. If smaller amounts than one mole are used, complete conversion to the monoamide does not take place, and a correspondingly reduced action is obtained.

In some cases, it may be advantageous for the amide/ammonium salt structure to be built up from two different amines. Thus, for example, a copolymer of lauryl acrylate and maleic anhydride can firstly be reacted with a secondary amine, such as hydrogenated ditallow fatty amine, to give the amide, after which the free carboxyl group originating from the anhydride is neutralized using another amine, for example 2-ethylhexylamine, to give the ammonium salt. The reverse procedure is equally conceivable: reaction is firstly carried out with ethylhexylamine to give the monoamide, then with ditallow fatty amine to give the ammonium salt. Preferably at least one amine is used here which has at least one straight-chain, unbranched alkyl group having more than 16 carbon atoms. It is not important here whether this amine is present in the build-up of the amide structure or as the ammonium salt of the dicarboxylic acid.

Instead of the subsequent reaction of the carboxyl groups or of the dicarboxylic anhydride with amines to give the corresponding amides or amide/ammonium salts, it may sometimes be advantageous to prepare the monoamides or amide/ammonium salts of the monomers and then to copolymerize these directly in the polymerization. Usually, however, this is much more technically complex, since the amines are able to add onto the double bond of the monomeric dicarboxylic acid, and copolymerization is then no longer possible.

8. Terpolymers based on α,β-unsaturated dicarboxylic anhydrides, α,β-unsaturated compounds and polyoxyalkylene ethers of lower, unsaturated alcohols which comprise 20-80 mol %, preferably 40-60 mol %, of divalent structural units of the formulae 1 and/or 3, and optionally 2, the structural units 2 originating from unreacted anhydride radicals, (1)

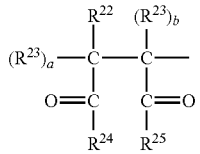

(2)

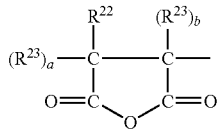

(3)

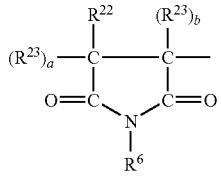

where $R^{22}$ and $R^{23}$ are each independently hydrogen or methyl, a and b are zero or one and a+b is one, $R^{24}$ and $R^{25}$ are identical or different and are each —$NHR^6$, $N(R^6)_2$ and/or —$OR^{27}$ groups, and $R^{27}$ is a cation of the formula $H_2N(R^6)_2$ or $H_3NR^6$, 19-80 mol %, preferably 39-60 mol %, of divalent structural units of the formula 4

(4)

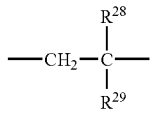

in which $R^{28}$ is hydrogen or $C_1$-$C_4$-alkyl, and $R^{29}$ is $C_6$-$C_{60}$-alkyl or $C_6$-$C_{18}$-aryl, and 1-30 mol %, preferably 1-20 mol %, of divalent structural units of the formula 5

(5)

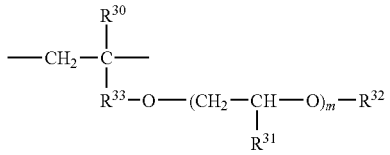

in which $R^{30}$ is hydrogen or methyl, $R^{31}$ is hydrogen or $C_1$-$C_4$-alkyl, $R^{33}$ is $C_1$-$C_4$-alkylene, m is a number from 1 to 100, $R^{32}$ is $C_1$-$C_{24}$-alkyl, $C_5$-$C_{20}$-cycloalkyl, $C_6$-$C_{18}$-aryl or —C(O)—$R^{34}$ where $R^{34}$ is $C_1$-$C_{40}$-alkyl, $C_5$-$C_{10}$-cycloalkyl or $C_6$-$C_{18}$-aryl.

The abovementioned alkyl, cycloalkyl and aryl radicals may be substituted or unsubstituted. Suitable substituents of the alkyl and aryl radicals are, for example, ($C_1$-$C_6$)-alkyl, halogens, such as fluorine, chlorine, bromine and iodine, preferably chlorine, and ($C_1$-$C_6$)-alkoxy.

Alkyl here is a straight-chain or branched hydrocarbon radical. Specific examples include: n-butyl, tert-butyl, n-hexyl, n-octyl, decyl, dodecyl, tetradecyl, hexadecyl, octadecyl, dodecenyl, tetrapropenyl, tetradecenyl, pentapropenyl, hexadecenyl, octadecenyl and eicosanyl, or mixtures, such as coconut alkyl, tallow fatty alkyl and behenyl.

Cycloalkyl here is a cyclic aliphatic radical having 5-20 carbon atoms. Preferred cycloalkyl radicals are cyclopentyl and cyclohexyl.

Aryl here is a substituted or unsubstituted aromatic ring system having from 6 to 18 carbon atoms.

The terpolymers consist of the divalent structural units of the formulae 1 and 3, and 4 and 5, and optionally 2. They additionally only contain, as known per se, the end groups formed in the polymerization by initiation, inhibition and chain termination.

In detail, structural units of the formulae 1 to 3 are derived from α,β-unsaturated dicarboxylic anhydrides of the formulae 6 and 7

(6)

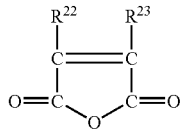

(7)

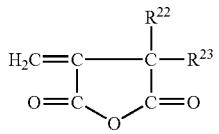

such as maleic anhydride, itaconic anhydride, citraconic anhydride, preferably maleic anhydride.

The structural units of the formula 4 are derived from the α-β-unsaturated compounds of the formula 8.

(8)

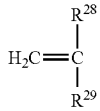

Examples include the following α,β-unsaturated olefins: styrene, α-methylstyrene, dimethylstyrene, α-ethylstyrene, diethylstyrene, i-propylstyrene, tert-butylstyrene, diisobutylene and α-olefins, such as decene, dodecene, tetradecene, pentadecene, hexadecene, octadecene, $C_{20}$-α-olefin, $C_{24}$-α-olefin, $C_{30}$-α-olefin, tripropenyl, tetrapropenyl, pentapropenyl and mixtures thereof. Preference is given to α-olefins having from 10 to 24 carbon atoms and styrene, particularly preference to α-olefins having from 12 to 20 carbon atoms.

The structural units of the formula 5 are derived from polyoxyalkylene ethers of lower, unsaturated alcohols of the formula 9.

(9)

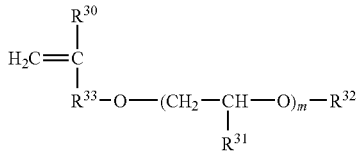

The monomers of the formula 9 are products of the etherification ($R^{32}$=—C(O)$R^{34}$) or esterification ($R^{32}$=C(O)$R^{34}$) of polyoxyalkylene ethers ($R^{32}$=H).

The polyoxyalkylene ethers ($R^{32}$=H) can be prepared by processes known per se, for example by the addition of α-olefin oxides, such as ethylene oxide, propylene oxide and/or butylene oxide, onto polymerizable, lower, unsaturated alcohols of the formula 10

(10)

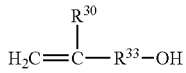

and subsequent esterification or etherification. Polymerizable, lower, unsaturated alcohols of this type are, for example, allyl alcohol, methallyl alcohol, butenols, such as 3-buten-1-ol and 1-buten-3-ol, or methylbutenols, such as 2-methyl-3-buten-1-ol, 2-methyl-3-buten-2-ol and 3-methyl-3-buten-1-ol. Preference is given to the products of the addition of ethylene oxide and/or propylene oxide onto allyl alcohol.

Examples of primary amines suitable for the preparation of the terpolymers include the following: n-hexylamine, n-octylamine, n-tetradecylamine, n-hexadecylamine, n-stearylamine or also N,N-dimethylaminopropylenediamine, cyclohexylamine, dehydroabietylamine and mixtures thereof.

Examples of secondary amines which are suitable for the preparation of the terpolymers include the following: didecylamine, ditetradecylamine, distearylamine, dicoconut fatty amine, ditallow fatty amine and mixtures thereof.

The terpolymers have K values (measured by the Ubbelohde method in 5% by weight solution in toluene at 25° C.) of from 8 to 100, preferably from 8 to 50, corresponding to average molecular weights ($M_w$) of from about 500 to 100,000. Suitable examples are listed in EP 606 055.

9. Products of the reaction of alkanolamines and/or polyether-amines with polymers containing dicarboxylic anhydride groups, which comprise 20-80 mol %, preferably 40-60 mol %, of divalent structural units of the formulae 13 and 15 and optionally 14

(13)

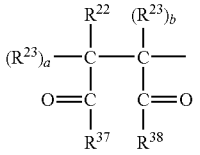

(14)

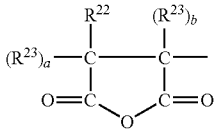

(15)

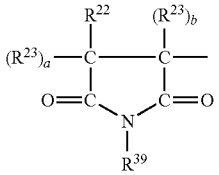

where $R^{22}$ and $R^{23}$ are each independently hydrogen or methyl, a and b are zero or 1, and a+b is 1, $R^{37}$=—OH, —O—[$C_1$-$C_{30}$-alkyl], —$NR^6R^7$, —$O^sN^rR^6R^7H_2$ $R^{38}$=$R^{37}$ or $NR^6R^{39}$ $R^{39}$=-$(A\text{-}O)_x$-E where A=an ethylene or propylene group, x=from 1 to 50, E=H, $C_1$-$C_{30}$-alkyl, $C_5$-$C_{12}$-cycloalkyl or $C_6$-$C_{30}$-aryl, and 80-20 mol %, preferably 60-40 mol %, of divalent structural units of the formula 4.

In detail, the structural units of the formulae 13, 14 and 15 are derived from α,β-unsaturated dicarboxylic anhydrides of the formulae 6 and/or 7.

The structural units of the formula 4 are derived from the α,β-unsaturated olefins of the formula 8. The abovementioned alkyl, cycloalkyl and aryl radicals have the same meanings as under 8.

The radicals $R^{37}$ and $R^{38}$ in formula 13 and $R^{39}$ in formula 15 are derived from polyether-amines or alkanolamines of the formulae 16 a) and b), amines of the formula $NR^6R^7R^8$ and optionally alcohols having from 1 to 30 carbon atoms.

(16a)

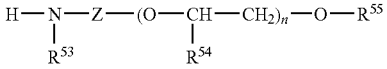

(16b)

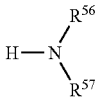

In these formulae, $R^{53}$ is hydrogen, $C_6$-$C_{40}$-alkyl or (16c)

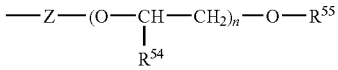

$R^{54}$ is hydrogen or $C_1$-$C_4$-alkyl $R^{55}$ is hydrogen, $C_1$- to $C_4$-alkyl, $C_5$- to $C_{12}$-cycloalkyl or $C_6$- to $C_{30}$-aryl $R^{56}$ and $R^{57}$ are each independently hydrogen, $C_1$- to $C_{22}$-alkyl, $C_2$- to $C_{22}$-alkenyl or Z—OH Z is $C_2$- to $C_4$-alkylene n is a number from 1 to 1000.

The structural units of the formulae 6 and 7 have preferably been derivatized using mixtures of at least 50% by weight of alkylamines of the formula $HNR^6R^7R^8$ and at most 50% by weight of polyether-amines or alkanolamines of the formulae 16 a) and b).

Another possibility for the derivatization of the structural units of the formulae 6 and 7 comprises employing an alkanolamine of the formulae 16a) or 16b) instead of the polyether-amines and subsequently subjecting the product to oxyalkylation.

From 0.01 to 2 mol, preferably from 0.01 to 1 mol, of alkanolamine are employed per mole of anhydride. The reaction temperature is from 50 to 100° C. (amide formation). In the case of primary amines, the reaction is carried out at temperatures above 100° C. (imide formation).

The oxyalkylation is typically carried out at temperatures of from 70 to 170° C. with catalysis by bases, such as NaOH or $NaOCH_3$, by introducing gaseous alkylene oxides, such as ethylene oxide (EO) and/or propylene oxide (PO). From 1 to 500 mol, preferably from 1 to 100 mol, of alkylene oxide are usually added per mole of hydroxyl groups.

Examples of suitable alkanolamines include the following: monoethanolamine, diethanolamine, N-methylethanolamine, 3-aminopropanol, isopropanol, diglycol amine, 2-amino-2-methylpropanol and mixtures thereof.

Examples of primary amines include the following: n-hexylamine, n-octylamine, n-tetradecylamine, n-hexadecylamine, n-stearylamine or else N,N-dimethylaminopropylenediamine, cyclohexylamine, dehydroabietylamine and mixtures thereof.

Examples of secondary amines include the following: didecylamine, ditetradecylamine, distearylamine, dicoconut fatty amine, ditallow fatty amine and mixtures thereof.

Examples of alcohols include the following: methanol, ethanol, propanol, isopropanol, n-, sec-, and tert-butanol, octanol, tetradecanol, hexadecanol, octadecanol, tallow fatty alcohol, behenyl alcohol and mixtures thereof. Suitable examples are listed in EP-A-688 796.

10. Copolymers and terpolymers of N—$C_6$-$C_{24}$-alkylmaleimide with $C_1$-$C_{30}$-vinyl esters, vinyl ethers and/or olefins having from 1 to 30 carbon atoms, for example styrene or α-olefins. These can be obtained either by reaction of a polymer containing anhydride groups with amines of the formula $H_2NR^6$ or by imidation of the dicarboxylic acid followed by copolymerization. The preferred dicarboxylic acid here is maleic acid or maleic anhydride. Preference is given here to copolymers comprising from 10 to 90% by weight of $C_6$-$C_{24}$-α-olefins and from 90 to 10% by weight of N—$C_6$-$C_{22}$-alkylmaleimide.

The polar nitrogen-containing paraffin dispersants may be added to the additives according to the invention or added separately to the additized middle distillate. The ratio between paraffin dispersants and the additives according to the invention is between 5:1 and 1:5 and preferably between 3:1 and 1:3.

To prepare additive packages for specific solutions to problems, the additives according to the invention may also be used together with one or more oil-soluble coadditives which in themselves improve the lubricity and/or cold-flow properties of crude oils, lubricant oils or fuel oils. Examples of such coadditives are vinyl acetate-containing copolymers or terpolymers of ethylene, comb polymers and also oil-soluble amphiphiles.

For instance, mixtures of the additives according to the invention with copolymers which contain from 10 to 40% by weight of vinyl acetate and from 60 to 90% by weight of ethylene have proven outstandingly suitable. In a further embodiment of the invention, the additives according to the invention are used in a mixture with ethylene/vinyl acetate/vinyl 2-ethylhexanoate terpolymers, ethylene/vinyl acetate/vinyl neononanoate terpolymers and/or ethylene/vinyl acetate/vinyl neodecanoate terpolymers to simultaneously improve the flowability and lubricity of mineral oils or mineral oil distillates. Apart from ethylene, the terpolymers of vinyl 2-ethylhexanoates, vinyl neononanoates or vinyl neodecanoates contain from 10 to 35% by weight of vinyl acetate and from 1 to 25% by weight of the particular long-chain vinyl ester. In addition to ethylene and from 10 to 35% by weight of vinyl esters, further preferred copolymers also contain from 0.5 to 20% by weight of olefin having from 3 to 10 carbon atoms, for example isobutylene, diisobutylene, 4-methylpentene or norbornene.

Finally, in a further embodiment of the invention, the additives according to the invention are used together with comb polymers. This refers to polymers in which hydrocarbon radicals having at least 8, in particular at least 10, carbon atoms are bonded to a polymer backbone. These are preferably homopolymers whose alkyl side chains have at least 8 and in particular at least 10 carbon atoms. In copolymers, at least 20%, preferably at least 30%, of the monomers have side chains (cf. Comb-like Polymers-Structure and Properties; N. A. Platé and V. P. Shibaev, J. Polym. Sci. Macromolecular Revs. 1974, 8, 117 ff). Examples of suitable comb polymers are, for example, fumarate/vinyl acetate copolymers (cf. EP 0 153 76 A1), copolymers of a $C_6$-$C_{24}$-α-olefin and an N—$C_6$-$C_{22}$-alkylmaleimide (cf. EP 0 320 766), and also esterified olefin/maleic anhydride copolymers, polymers and copolymers of α-olefins and esterified copolymers of styrene and maleic anhydride.

Comb polymers can be described, for example, by the formula

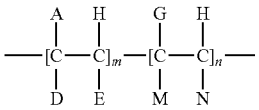

In this formula:

A is R', COOR', OCOR', R"—COOR' or OR';

D is H, $CH_3$, A or R;

E is H or A;

G is H, R", R"—COOR', an aryl radical or a heterocyclic radical;

M is H, COOR", OCOR", OR" or COOH;

N is H, R", COOR", OCOR, COOH or an aryl radical;

R' is a hydrocarbon chain having 8-150 carbon atoms;

R" is a hydrocarbon chain having from 1 to 10 carbon atoms;

m is a number between 0.4 and 1,0; and n is a number between 0 and 0.6.

The mixing ratio (in parts by weight) of the additives according to the invention with ethylene copolymers or comb polymers is in each case from 1:10 to 20:1, preferably from 1:1 to 10:1.

The additives according to the invention are added to oils in amounts of from 0.0001 to 1% by weight, preferably from 0.001 to 0.1% by weight and especially from 0.002 to 0.05% by weight. They may be used as such or else dissolved in solvents, for example aliphatic and/or aromatic hydrocarbons or hydrocarbon mixtures, for example toluene, xylene, ethylbenzene, decane, pentadecane, petroleum fractions, diesel, kerosene or commercial solvent mixtures such as Solvent Naphtha, ®Shellsol AB, ®Solvesso 150, ®Solvesso 200 and ®Exxsol, ®Isopar and ®Shellsol D types, and also polar solvents such as alcohols, glycols and esters, for example fatty acid alkyl esters and in particular rapeseed oil methyl ester (RME). The additives according to the invention preferably contain up to 70%, especially 5-60%, in particular 10-40% by weight of solvent.

The additives according to the invention can be stored without aging effects at elevated temperature over a long period, without any symptoms of aging occurring, such as resinification and the formation of insoluble structures or deposits in storage containers and/or engine parts. In addition, they improve the oxidation stability of the additized oils with simultaneous reduced tendency to emulsify. This is advantageous in particular in oils which contain relatively large fractions of oils from cracking processes.

In addition, they exhibit an improvement in lubricity of middle distillates superior to the individual components. This allows the dosage required for the setting of the specification to be reduced.

A further advantage of the additives according to the invention is their reduced crystallization temperature compared to the fatty acid esters used as lubricity additives in the prior art. For instance, they can also be used at low temperatures of, for example, from 0° C. to −20° C. and sometimes even lower without any problem.

The additives according to the invention are particularly well suited to use in middle distillates. Middle distillates refer in particular to those mineral oils which are obtained by distillation of crude oil and boil in the range from 120 to 450° C., for example kerosene, jet fuel, diesel and heating oil. The oils can also contain alcohols such as methanol and/or ethanol or consist of these. The additives according to the invention are preferably used in those middle distillates which contain fewer than 350 ppm of sulfur, in particular fewer than 200 ppm of sulfur and in special cases fewer than 50 ppm or fewer than 110 ppm, of sulfur. These are generally those middle distillates which have been subjected to refining under hydrogenating conditions, and therefore only contain small fractions of polyaromatic and polar compounds which confer a natural lubricity on them. The additives according to the invention are also preferably used in those middle distillates which have 95% distillation points below 370° C., in particular 350° C. and in special cases below 330° C. The additives according to the invention are equally suitable for use in synthetic fuels likewise having low lubricity, for example as produced in the Fischer-Tropsch process. The oils having improved lubricity have a Wear Scar Diameter measured in the HFRR test of preferably less than 460 μm, especially less than 450 μm. The additives according to the invention can also be used as components in lubricant oils.

The mixtures can be used alone or else together with other additives, for example with pour point depressants, corrosion inhibitors, antioxidants, sludge inhibitors, dehazers, conductivity improvers, lubricity additives, and additives for reducing the cloud point. They are also used successfully together with additive packages which contain, inter alia, known ashless dispersing additives, detergents, antifoams, antioxidants, dehazers, demulsifiers and corrosion inhibitors.

The advantages of the additives according to the invention are illustrated in detail by the examples which follow.

EXAMPLES

TABLE 1

Characterization of the test oils used

| | Test oil 1 | Test oil 2 | Test oil 3 |
|---|---|---|---|
| Distillation | | | |
| IBP [° C.] | 202 | 182 | 164 |
| 20% [° C.] | 237 | 221 | 214 |
| 90% [° C.] | 321 | 280 | 342 |
| FBP [° C.] | 348 | 304 | 367 |
| Cloud Point [° C.] | −5.9 | −29.7 | −7.7 |
| CFPP [° C.] | −8 | −33 | −13 |
| Density at 15° C. [g/cm$^3$] | 0.8348 | 0.8210 | 0.8293 |
| Sulfur [ppm] | 32 | 6 | 195 |

The additives used are characterized hereinbelow. The OH numbers were determined to DIN 53240 by reacting with a defined amount of excess acetic anhydride and subsequently titrating the acetic acid formed.

Iodine numbers are determined according to Kaufmann. In this method, the sample is admixed with a defined amount of a methanolic bromine solution, which results in an amount of bromine equivalent to the content of double bonds adding onto them. The excess of bromine is back-titrated using sodium thiosulfate.

TABLE 2

Characterization of the lubricity additives used

| Example | Chemical description | OH number [mg KOH/g] | Iodine number [gl/100 g] |
|---|---|---|---|
| A1 | Partial ester of glycerol and soya oil fatty acid | 158 | 103 |
| A2 | Partial ester of glycerol and tall oil fatty acid | 88 | 116 |
| A3 | Partial ester of glycerol and tall oil fatty acid | 193 | 122 |
| A4 | Partial ester of glycerol and tallow fatty acid | 181 | 52 |
| A5 | Partial ester of glycerol and olein | 278 | 77 |
| A6 | Partial ester of glycerol and olein | 153 | 76 |
| A7 | Glycerol monooleate, technical grade | 197 | 83 |
| A8 | Glycerol dioleate | 68 | 86 |
| A9 | Pentaerythritol monooleate | 111 | 85 |

TABLE 3

Characterization of the alkylphenol resins used

| | |
|---|---|
| B1 | Nonylphenol-formaldehyde resin, prepared by condensing a mixture of nonylphenol having 0.5 mol % of dinonylphenol with formaldehyde, Mw 2000 g/mol; 50% in Solvent Naphtha |
| B2 | Dodecylphenol-formaldehyde resin, prepared by condensing a mixture of dodecylphenol having 1.3 mol % of didodecylphenol with formaldehyde, Mw 2200 g/mol; 50% in Solvent Naphtha |
| B3 | $C_{20}$-$C_{24}$-Alkylphenol-formaldehyde resin, prepared by condensing a mixture of $C_{20}$-$C_{24}$-alkylphenol having 35 mol % of di-($C_{20}$-$C_{24}$-alkyl)phenol with formaldehyde, Mw 2500 g/mol; 50% in Solvent Naphtha |

TABLE 4

Characterization of the polar nitrogen-containing compounds used

| | |
|---|---|
| C1 | Reaction product of a dodecenyl-spiro-bislactone with a mixture of primary and secondary tallow fatty amine, 60% in Solvent Naphtha (prepared according to EP 0413279) |
| C2 | Reaction product of a terpolymer of a C14/16-α-olefin, maleic anhydride and allyl polyglycol with 2 equivalents of ditallow fatty amine, 50% in Solvent Naphtha (prepared according to EP 0606055) |
| C3 | Reaction product of phthalic anhydride and 2 equivalents of di(hydrogenated tallow fatty) amine, 50% in Solvent Naphtha (prepared according to EP 0061894) |
| C4 | Reaction product of ethylenediaminetetraacetic acid with 4 equivalents of ditallow fatty amine to give the amide-ammonium salt (prepared according to EP 0398101) |

Oxidation Stability of the Additives 10 g of the additive (mixture) to be tested are weighed into a 500 ml Erlenmeyer flask. The flask is stored in a drying cabinet at a temperature of 90° C. for three days, and the atmosphere above the additive is changed daily by passing over an air stream.

After the conditioning, the mixture is allowed to cool to room temperature for one hour. Subsequently, the mixture is admixed with 500 ml of diesel fuel (test oil 3) and mixed thoroughly. After standing for a period of two hours, the mixture is visually examined for any deposits, cloudiness, insoluble fractions, etc., which give indications of oxidative changes (visual examination). The mixture is then filtered through a 0.8 μm filter at a pressure differential of 800 mbar. The entire amount has to be filterable within 2 minutes, otherwise the volume which has been filtered after 2 minutes is noted.

TABLE 5

Oxidation stability

| Example | A | B | Visual examination | Filtration |
|---|---|---|---|---|
| 1 (comp.) | — | — | clear | 34 s |
| 2 | 10 g A1 | — | cloudy; insoluble fractions | n.a. |
| 3 (comp.) | 9.9 g A1 | 0.1 g B1 | clear | 62 s |
| 4 | 9.9 g A1 | 0.1 g B2 | clear | 57 s |
| 5 (comp.) | 10 g A2 | — | cloudy; insoluble fractions | n.a. |
| 6 | 9.9 g A2 | 0.1 g B1 | clear | 53 s |
| 7 (comp.) | 10 g A4 | — | cloudy | 120 s/ 260 ml |
| 8 | 9.9 g A4 | 0.1 g B1 | clear | 49 s |
| 9 | 9 g A4 | 1 g B2 | clear | 52 s |
| 10 (comp.) | 10 g A5 | — | cloudy; insoluble fractions | n.a. |

TABLE 5-continued

| Oxidation stability | | | | |
|---|---|---|---|---|
| Example | A | B | Visual examination | Filtration |
| 11 | 9.9 g A5 | 0.1 g B1 | clear | 57 s |
| 12 (comp.) | 10 g A3 | — | cloudy; insoluble fractions | n.a. |

TABLE 5-continued

| Oxidation stability | | | | |
|---|---|---|---|---|
| Example | A | B | Visual examination | Filtration |
| 13 | 5 g A3 | 5 g B1 | clear | 68 s |
| 14 | 9.9 g A3 | 0.1 g B2 | clear | 63 s |
| 15 | 9.99 g A3 | 0.01 g B3 | clear | 76 s |
| 16 (comp.) | 10 g A8 | — | cloudy; insoluble fractions | n.a. |
| 17 | 5 g A8 | 5 g B1 | clear | 84 s |
| 18 | 9.9 g A8 | 0.1 g B1 | clear | 60 s |
| 19 | 9.99 g A8 | 0.01 g B1 | clear | 72 s |
| 20 | 9.9 g A8 | 0.1 g B3 | clear | 62 s |

n.a. = not applicable, since not completely soluble

Example 21

A mixture of 9 g of A 7, 1 g of B1 and 2 g of C2, after storage at 90° C. for three days and subsequent dilution with 500 ml of test oil 3, gave a clear solution and a filtration time of 65 s.

Cold Stability of the Additives

Various esters were stored at 15° C., +5° C. and −5° C., each for 5 days, and examined visually after 3 or 5 days for flowability and any deposits or cloudiness. The assessments have the following meanings:

+ flowable and clear

○ flowable but cloudy or with deposits

- solid

TABLE 6

| Cold stability of the additives | | | | | | | | |
|---|---|---|---|---|---|---|---|---|
| | Additive | | 15° C. | | +5° C. | | −5° C. | |
| Example | Fraction A | Fraction B | 3 days | 5 days | 3 days | 5 days | 3 days | 5 days |
| 22 (comp.) | A5 | — | ○ | — | — | | | |
| 23 | 2 parts of A5 | 1 part of B1 | + | ○ | ○ | — | — | |
| 24 | 1 part of A5 | 1 part of B1 | + | + | + | ○ | — | |
| 25 | 1 part of A5 | 2 parts of B1 | + | + | + | + | — | |
| 26 (comp.) | A6 | — | + | + | ○ | — | | |
| 27 | 2 parts of A6 | 1 part of B2 | + | + | + | + | ○ | ○ |
| 28 | 1 part of A6 | 1 part of B2 | + | + | + | + | + | + |
| 29 | 1 part of A6 | 2 parts of B2 | + | + | + | + | + | + |
| 30(comp.) | A7 | — | ○ | — | — | | | |
| 31 | 2 parts of A7 | 1 part of B1 | + | + | + | + | — | |
| 32 | 1 part of A7 | 1 part of B1 | + | + | + | + | — | |
| 33 | 1 part of A7 | 2 parts of B1 | + | + | + | + | + | + |
| 34 (comp.) | A3 | — | + | + | + | + | ○ | — |
| 35 | 2 parts of A3 | 1 part of B1 | + | + | + | + | + | + |
| 36 | 1 part of A3 | 1 part of B1 | + | + | + | + | + | + |
| 37 | 1 part of A3 | 2 parts of B1 | + | + | + | + | + | + |
| 38 (comp.) | A8 | — | + | + | + | ○ | — | |
| 39 | 2 parts of A8 | 1 part of B1 | + | + | + | + | ○ | ○ |
| 40 | 1 part of A8 | 1 part of B1 | + | + | + | + | + | + |
| 41 | 1 part of A8 | 2 parts of B1 | + | + | + | + | + | + |
| 42 (comp.) | A9 | — | + | + | + | ○ | ○ | — |
| 43 | 2 parts of A9 | 1 part of B1 | + | + | + | + | + | + |
| 44 | 1 part of A9 | 1 part of B1 | + | + | + | + | + | + |
| 45 | 1 part of A9 | 2 parts of B1 | + | + | + | + | + | + |

Lubricity in Middle Distillates

The lubricity of the additives was tested on additized oils at 60° C. by means of an HFRR instrument from PCS Instruments. The high frequency reciprocating rig test (HFRR) is described in D. Wei, H. Spikes, Wear, Vol. 111, No. 2, p. 217, 1986. The results are quoted as friction coefficient and wear scar (WS 1.4). A low wear scar and a low coefficient of friction indicate good lubricity. Wear scar values of less than 460 μm are regarded as an indication of sufficient lubricity, although values of less than 400 μm are sought in practice. The dosages in Table 6 relate to the amount of added active ingredient.

TABLE 7

| Wear scar in test oil 1 | | | | | |
|---|---|---|---|---|---|
| Example | Dosage of A | Dosage of B | Dosage of C | Wear Scar | Friction |
| 46 (comp.) | — | — | — | 575 | 0.38 |
| 47 (comp.) | 80 ppm A1 | — | — | 536 | 0.32 |
| 48 (comp.) | 100 ppm A1 | — | — | 427 | 0.22 |
| 49 | 80 ppm A1 | 20 ppm B2 | — | 380 | 0.21 |

TABLE 7-continued

| Wear scar in test oil 1 | | | | | |
|---|---|---|---|---|---|
| Example | Dosage of A | Dosage of B | Dosage of C | Wear Scar | Friction |
| 50 | 70 ppm A1 | 20 ppm B2 | 10 ppm | 364 | 0.18 |
| 51 (comp.) | 50 ppm A3 | — | — | 566 | 0.37 |
| 52 (comp.) | 75 ppm A3 | — | — | 523 | 0.25 |
| 53 (comp.) | 100 ppm A3 | — | — | 395 | 0.23 |
| 54 (comp.) | — | 50 ppm B1 | — | 570 | 0.38 |
| 55 (comp.) | — | — | 40 ppm C2 | 566 | 0.34 |
| 56 (comp.) | 75 ppm A3 | — | 40 ppm C2 | 412 | 0.23 |
| 57 (comp.) | — | 20 ppm B1 | 40 ppm C2 | 550 | 0.34 |
| 58 | 75 ppm A3 | 20 ppm B1 | — | 366 | 0.20 |
| 59 | 75 ppm A3 | 20 ppm B1 | 40 ppm C2 | 276 | 0.18 |
| 60 | 50 ppm A3 | 50 ppm B1 | — | 425 | 0.22 |
| 61 | 50 ppm A3 | 20 ppm B1 | — | 458 | 0.24 |
| 62 | 50 ppm A3 | 20 ppm B1 | 30 ppm C2 | 378 | 0.20 |

TABLE 8

| Wear scar in test oil 2 | | | | | |
|---|---|---|---|---|---|
| Example | Dosage of A | Dosage of B | Dosage of C | Wear Scar | Friction |
| 63 (comp.) | — | — | — | 611 | 0.41 |
| 64 (comp.) | 100 ppm A2 | — | — | 551 | 0.25 |
| 65 (comp.) | 120 ppm A2 | — | — | 352 | 0.19 |
| 66 (comp.) | — | 10 ppm B1 | — | 613 | 0.41 |
| 67 (comp.) | — | — | 10 ppm C1 | 603 | 0.41 |
| 68 | 90 ppm A2 | 10 ppm B1 | — | 457 | 0.23 |
| 69 | 100 ppm A2 | 10 ppm B2 | — | 322 | 0.17 |
| 70 | 80 ppm A2 | 10 ppm B1 | 10 ppm C1 | 384 | 0.20 |
| 71 | 70 ppm A2 | 10 ppm B2 | 10 ppm C1 | 436 | 0.22 |
| 72 | 80 ppm A2 | 10 ppm B1 | 10 ppm C3 | 413 | 0.21 |
| 73 | 80 ppm A2 | 10 ppm B1 | 10 ppm C4 | 407 | 0.21 |

What is claimed is:

1. A process for improving oxidation stability of at least one partial ester composed of a di- or polyhydric alcohol and a fatty acid mixture of unsaturated and optionally also saturated fatty acids whose carbon chain lengths are between 8 and 30 carbon atoms, wherein at least 60% of said fatty acids have fatty acid radicals containing at least one double bond, said process comprising adding to the at least one partial ester, at least one alkylphenol-aldehyde resin, obtained by the condensation of (i) at least one alkylphenol having at least one $C_6$-$C_{24}$-alkyl or $C_6$-$C_{24}$-alkenyl radical and (ii) at least one aldehyde or ketone, to a degree of condensation of between 2 and 50 alkylphenol units.

2. The process of claim 1, wherein the at least one partial ester has an iodine number of more than 50 g of I/100 g of said partial ester.

3. The process of claim 1, wherein the at least one partial ester has an OH number of between 10 and 200 mg of KOH/g of said partial ester.

4. The process of claim 1, wherein said fatty acids have carbon chain lengths from 10 to 26 carbon atoms.

5. The process of claim 1, wherein the fatty acid mixture comprises up to 20% by weight of saturated fatty acids.

6. The process of claim 1, wherein the fatty acid mixture comprises one or more dicarboxylic acids.

7. The process of claim 1, wherein the di- or polyhydric alcohol has from 2 to 6 carbon atoms.

8. The process of claim 1, wherein the di- or polyhydric alcohol has from 2 to 5 hydroxyl groups, with a maximum of one hydroxyl group per carbon atom.

9. The process of claim 1, which also comprises at least one nitrogen-containing paraffin dispersant.

10. The process of claim 1, further comprising at least one ethylene copolymer.

11. The process of claim 1, further comprising at least one comb polymer.

12. The process of claim 1, wherein the at least one alkylphenol-aldehyde resin is added in an amount of 0.001 to 10 wt.-% based on the weight of said partial ester.

* * * * *